United States Patent [19]

Kehrer et al.

[11] Patent Number: 4,864,534

[45] Date of Patent: Sep. 5, 1989

[54] APPARATUS AND METHOD FOR ENTERING SETTING COMMANDS IN A COMPUTER-CONTROLLED INTERLOCKING SYSTEM

[75] Inventors: Jurgen Kehrer, Ditzingen; Harald Schulz, Benningen, both of Fed. Rep. of Germany

[73] Assignee: Alcatel N.V., Amsterdam, Netherlands

[21] Appl. No.: 111,939

[22] Filed: Oct. 21, 1987

[30] Foreign Application Priority Data

Oct. 25, 1986 [DE] Fed. Rep. of Germany ..... 3636426

[51] Int. Cl.[4] ..... G06F 5/00

[52] U.S. Cl. ..... 364/900; 364/947.2; 364/958

[58] Field of Search ... 364/200 MS File, 900 MS File

[56] References Cited

U.S. PATENT DOCUMENTS 4,255,796 3/1981 Gabbe et al. ..... 364/900
4,418,275 11/1983 Oosterbaan et al. ..... 364/200
4,433,392 2/1984 Beaven ..... 364/200
4,611,272 9/1986 Lomet ..... 364/200
4,611,280 9/1986 Linderman ..... 364/200

OTHER PUBLICATIONS

R. Dachwald et al., "A New Digital Control Desk", Signal & Draht, (1983), No. 12, pp. 219–223 (Informal English Translation).

*Primary Examiner*—Thomas M. Heckler
*Attorney, Agent, or Firm*—Christie, Parker & Hale

[57] ABSTRACT

A method is disclosed for converting operator inputs into control commands in a computer-controlled interlocking system. For standard inputs, a search method is used instead of a complicated and time-consuming syntax analysis. Using a pseudorandom technique, a search code is determined from the text entered into an input device. With the aid of this search code, the control command assigned to the input text is found in a previously compiled list of all control commands. Before being processed, the control command found is checked for agreement with the input by a direct comparison.

4 Claims, 2 Drawing Sheets

APPARATUS AND METHOD FOR ENTERING SETTING COMMANDS IN A COMPUTER-CONTROLLED INTERLOCKING SYSTEM

TECHNICAL FIELD

The present invention relates to apparatus and method for converting alphanumeric operator inputs into valid control commands in a computer-controlled railroad signal interlocking system.

BACKGROUND ART

A method of converting operator inputs into control commands in a computer-controlled interlocking system is known from an article by R. Dachwald and J. Raimer in "Signal+Draht 75" (1983), No. 12, in which the alphanumeric keyboard NstP S800 of Siemens is described on page 221 et seq.

In that method, the route setting commands are entered by means of alphanumeric characters into an input unit in a given syntactic form. Before the entered characters can be converted into target information, they are checked for format errors. This necessitates a so-called syntax analysis, a decoding process which is time-consuming and requires a large amount of storage. Compliance with predefined format rules is indispensable; a change in input format accordingly necessitates an alteration of the greater part of the input software. Computer search methods suitable for use in the present invention are known in other connections (see, for example, "Computer", No. 12 of May 29, 1985, pp. 53 et seq).

DISCLOSURE OF INVENTION

The object of the present invention is to provide an apparatus and a method of using the apparatus which permits simple and input-format-independent conversion of manually entered alphanumeric characters into valid route setting commands for an interlocking system.

A search code is derived from the entered and temporarily stored text by a pseudorandom technique. All possible valid control commands and associated operator inputs corresponding to the search code are successively retrieved from a list (ST) containing all valid control commands together with the operator inputs and search codes assigned to them. By logical comparison of the retrieved associated operator inputs with the entered and temporarily stored text, the control command corresponding to the temporarily stored text is determined.

This eliminates the need for a complicated and time-consuming syntax analysis of all inputs containing a relatively few characters, such as simple setting-command inputs. The syntax analysis thus needs to be used only for those inputs which would result in a prohibitively large number of possible combinations of valid input text, such as free text inputs or multidigit numeric inputs. Since the control commands found by the search method are stored together with the operator inputs assigned to them, these operator inputs can be compared with the entered text, and the associated control commands can be output for further utilization once agreement with the inputs has been determined. By this comparison, possible ambiguities (as may occur with a "HASH" code, for example), are resolved. At the same time the complicated plausibility checks as were necessary in the syntax analysis method of the prior art entry method are avoided.

A HASH search method such as is known in other connections (see, for example, "Computer", No. 12 of May 29, 1985, pp. 53 et seq) is especially suited for the interlocking system route setting commands described here, because it is fast and does not require much storage space.

If the HASH search method is used, instruction-type-specific software modules can be configured by project planning. The HASH search table acts as a switch on these modules. Control authorization areas and display areas can also be configured by project planning.

BRIEF DESCRIPTION OF DRAWINGS

An embodiment of the method according to the invention will now be described in detail with reference to the accompanying drawing, in which.

BEST MODE FOR CARRYING OUT THE INVENTION

Figure 1:
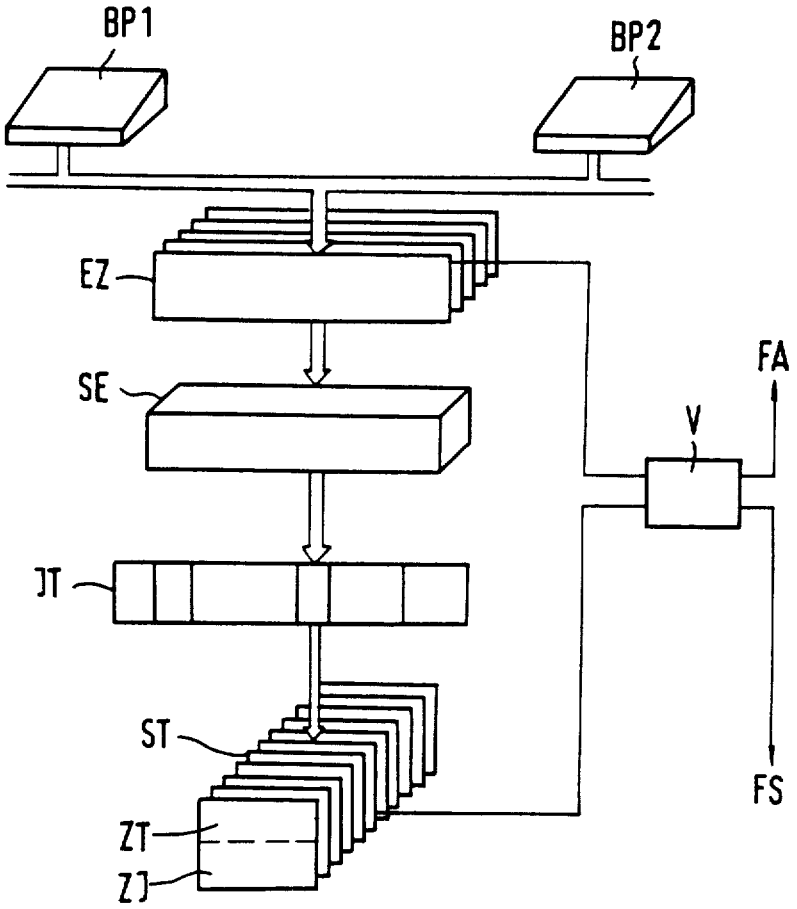
FIG. 1 shows schematically a data-entry apparatus for an interlocking system in accordance with the present invention.
Figure 2:
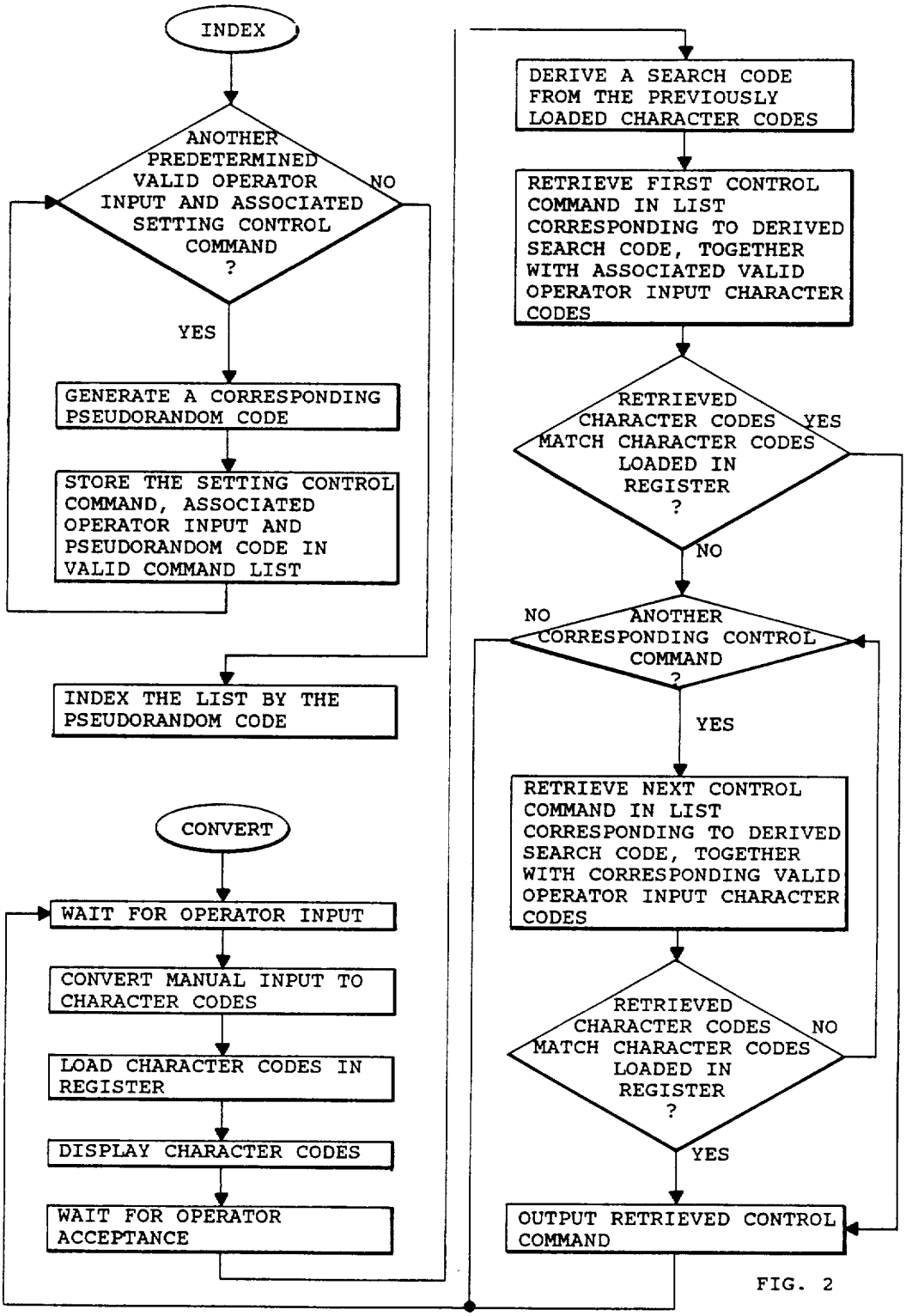
FIG. 2 is a flowchart illustrating the method aspects of the present invention.

FIG. 1 shows schematically the major functional blocks of a data-entry system in an interlocking system using the present invention, while FIG. 2 is a flowchart of the associated method. A number of operator consoles are provided with input devices BP1, BP2 which each have an alphanumeric keyboard and various function keys for entering special commands. Each of the input devices is connected to an input register EZ via a bus. The input register is a memory device which stores the entered information up to a maximum number of bits. The contents of the input register are presented on a display (not shown) for visual checking purposes.

When the operator input has been completed for a particular command—the end is identified by a special input symbol—a corresponding search code is determined in a special computational module SE. This search code may be a so-called HASH code, for example, which is computed according to the rule $$H = \sum_{i=1}^{m} (Wi - Ki) \bmod p.$$

where

- i is the bit position of the respective character in the input register,
- m is the maximum permissible number of digits of the entered text,
- Ki is a constant assigned to the ith location,
- Wi is the ASCII code of the character at the ith location, and
- p is the length (number of entries) of the list containing the valid control commands.

With the search code thus determined, the index code for a search table ST containing all permissible input texts for the target texts ZT of interest together with the respective target information ZJ assigned to them is retrieved from an index table JT.

As each index code need not have only a single target text assigned thereto, it thereafter is still necessary to compare the target text found with the original input text in order to make sure that the particular target information assigned to the text actually entered at the input device, which contains the setting command to be executed, is passed on to the interlocking logic. This comparison is performed in an comparator V which successively compares the different target texts found for a single index code with the original input and, in case of agreement, provides an enable signal FS which causes the target information to be passed on. If no target text is found for the index code, an error signal FA will be generated, which initiates an error analysis.

Since the method described becomes less efficient if very long texts are entered, in a step (not shown) preceding the determination of the search code, inputs containing more than a predetermined maximum number of characters or specific types of character strings, such as free text inputs or multidigit numbers, may be sorted out and processed separately.

The present invention has been described above with regard to the structure, function and use of a presently contemplated specific embodiment of the invention. It should be appreciated by those skilled in the art that many modifications and variations are possible. Accordingly the exclusive rights afforded hereby should be broadly construed, limited only by the spirit and scope of the appended claims.

What is claimed is:

1. A method of converting a predetermined set of valid operator inputs into respective associated setting control commands in a computer-controlled interlocking system, each of said setting control commands consisting of a plurality of alphanumeric characters, said method comprising the steps of:

for each such valid operator input and its associated setting control command to be so converted:

generating a corresponding pseudorandom code from the representation of the valid operator input as a string of alphanumeric character codes in accordance with a predetermined pseudorandom encoding technique, and storing the setting control command together with the string of alphanumeric character codes representing its associated operator input and its thus-generated corresponding pseudorandom code in a list of valid control commands;

indexing said list in accordance with said pseudorandom codes; thereafter, for each operator input corresponding to a single interlocking setting command to be so converted:

by means of an alphanumeric keyboard responsive to the manual input of the operator, generating a string of alphanumeric character codes representative of the operator's manual input;

temporarily storing and string of alphanumeric character codes in a register;

by means of a visual display, displaying a visual representation of the string of alphanumeric character codes temporarily stored in the resister to the operator for visual checking purposes;

deriving a search code from the string of alphanumeric character codes temporarily stored in the register using said pseudorandom encoding technique;

using the thus-derived search code to successively retrieve controls command corresponding to said search code, together with the strings of alphanumeric character codes representative of the associated operator inputs, from said list;

performing a logic comparison between each thus-retrieved string of alphanumeric character codes and the string of alphanumeric character codes temporarily stored in the register, and if the comparison is valid, outputting the retrieved control command.

2. A method as claimed in claim 1, wherein the search code is a HASH code which satisfies the rule:

$$H = \sum_{i=1}^{m} (Wi - Ki) \bmod p,$$

where

H is the encoded search code, i is the location of the respective alphanumeric character in the input register, m is the maximum permissible number of digits of the entered text, Ki is a constant assigned to the ith location, Wi is a ASCII mode of the alphanumeric character at the ith location, and p is the length of the list containing the control commands.

3. A method as claimed in claim 1 wherein said method is used only to process operator inputs having at most a predetermined number of characters.

4. A method as claim in claim 3 wherein operator inputs having more than said predetermined number of characters are separated from other operator inputs and processed separately.

* * * * *

UNITED STATES PATENT AND TRADEMARK OFFICE

CERTIFICATE OF CORRECTION

PATENT NO. : 4,864,534

DATED : September 5, 1989

INVENTOR(S) : J. Kehrer; H. Schulz

It is certified that error appears in the above-identified patent and that said Letters Patent is hereby corrected as shown below:

ON TITLE PAGE:

[73] Assignee; change "Alcatel N.V." to -- Standard Elektrik Lorenz AG, Stuttgart, Fed. Rep. of Germany --.

Column 3, line 4, change "an" to -- a --.

Column 4, line 3, after "storing" delete "and" and insert therefor -- said --.
Column 4, line 7, change "resister" to -- register --.
Column 4, line 39, before "ASCII" change "a" to -- the --.
Column 4, line 39, change "mode" to -- code --.

Signed and Sealed this

Tenth Day of September, 1991

*Attest:*

*Attesting Officer*

HARRY F. MANBECK, JR.

*Commissioner of Patents and Trademarks*